United States Patent [19]

Brunelle

[11] Patent Number: 4,462,117

[45] Date of Patent: Jul. 31, 1984

[54] DRAPABLE HEAD COVERING

[76] Inventor: Beatrice Y. Brunelle, 74-000 Shadow Mt. Dr., Palm Desert, Calif. 92260

[21] Appl. No.: 513,459

[22] Filed: Jul. 13, 1983

[51] Int. Cl.[3] ..... A42B 1/04

[52] U.S. Cl. ..... 2/202

[58] Field of Search ..... 2/202, 204, 207, 206, 2/198; 132/9

[56] References Cited

U.S. PATENT DOCUMENTS

| | | | |
|---|---|---|---|
| 2,735,110 | 2/1956 | Baker | 2/198 |
| 2,988,748 | 6/1961 | Rollins-Dudley | 2/202 |

FOREIGN PATENT DOCUMENTS

| | | | |
|---|---|---|---|
| 664490 | 5/1965 | Belgium | 2/198 |
| 124398 | 9/1931 | Fed. Rep. of Germany | 2/204 |

*Primary Examiner*—Doris L. Troutman

*Attorney, Agent, or Firm*—Fraser and Bogucki

[57] ABSTRACT

An easily drapable head covering is constructed in the form of a generally triangular scarf with elongated ends. The triangular shape conforms to a shallow isosceles triangle in which the base is substantially longer than either side and in which the apex is preferably contoured rather than forming a peak. A central segment of the scarf is elasticized to provide a head enclosure and a loop is attached at each side at an intermediate point between the base and sides to permit passage of the ends therethrough at each side and to further permit reverse passage of opposite ends through the opposite loop when the scarf is assembled on the head of a wearer with the ends tied together in any desired position.

9 Claims, 14 Drawing Figures

DRAPABLE HEAD COVERING

BACKGROUND OF THE INVENTION

The present invention relates to an article of head cover in the form of a hood covering or scarf constructed of flexible fabric or other material in a generally triangular form showing elongated ends which may be tied together around the head in a desired position.

Head scarves of this form are well known in the art but are limited both in appearance and utility by being limited to the simple applications inherent in the ability to tie the ends around the head either under the chin or at the back of the head. Prior U.S. Pat. No. 3,618,140 shows an example of this type of scarf also including a resilient band for securing the free ends of the scarf encircling the head.

SUMMARY OF THE INVENTION

An object of the present invention is to provide a head scarf which is easy-to-drape in relation to the head when it is placed in position with the crown or cap portion oriented in enclosing relation to the portion of the head of a wearer having a hair setting or hair style which projects some distance away from the scalp with the crown portion being spaced substantially from the scalp for receiving the hair setting or hair style without matting down the hair or otherwise causing the hair setting to be disarranged.

Another object of the present invention is to provide a head scarf in the form of a generally triangular piece of material having a relatively long base as compared with the height and an elastic band attached to the central portion of the piece of material at spaced points along the base and at points along each side of the piece of material in spaced relation to the apex or apical portion of the piece of material in the event the apex of the piece of material is rounded off to eliminate a generally triangular projection outwardly of the elastic band if desired.

A further important object of the present invention is to provide a head scarf in which the piece of material may be constructed of various types of fabrics, the dimensions may vary and the manner of attaching the elastic band may vary and the orientation of the full crown portion in relation to the head or hair setting may vary depending upon the hair style thereby enabling the scarf to be easily positioned on the head and automatically draped with the free tie ends being oriented in various positions in order to provide a selected style or configuration to the scarf.

Still another important object of the invention is to provide an easy-to-drape head scarf which is quite simple in construction, effective for protecting the hair setting, decorative in appearance and relatively inexpensive to manufacture.

These objects are attained by attaching loops or rings at each side of the scarf positioned at an intermediate point between an elasticized head encircling area and the elongated ends in a manner which will permit the ends to be drawn through the loops prior to being tied and which will also permit the ends to be drawn over the head and through the loop on the opposite side to form a loose and attractively draped turban.

BRIEF DESCRIPTION OF THE DRAWING

FIG. 7 is a front view in perspective showing the scarf positioned on the head of a wearer with the ends drawn through the side loops and over the head also through the opposite side loops to provide a draped turban, with ends tied at the back of the head.

FIGS. 7*a*, 7*b*, 7*c* and 7*d* show the stages of assembly of the ends through the loops in achieving the result shown in FIG. 7.

DETAILED DESCRIPTION

Figure 1:
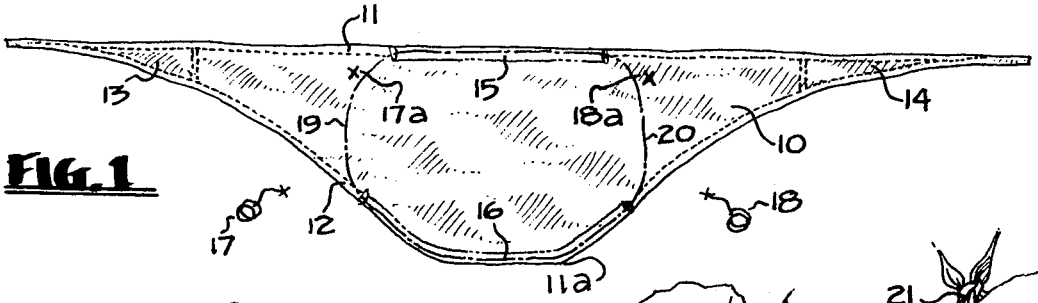
FIG. 1 is a plan view showing the generally triangular structure of the scarf as it is formed prior to application to the head of a wearer.

As shown in FIG. 1, the scarf 10 is formed from a generally triangular piece of fabric 12 having an elongated base 11 and an apex or contoured area 11*a* with elongated ends 13 and 14. The circular crown or cap portion is defined by an elastic member 19, 20, which is attached to the fabric in stretched condition and forms a circular head enclosing area. The elastic may be covered with a protective tape at front and rear as shown at 15, 16. Instead of being attached, the elastic may pass through spaced slots in the fabric.

The elastic band may be attached in various ways as by sewing or tacking at spaced points while stretched to cause a crown portion to be formed by gathering of the elastic. As mentioned above, it may be enclosed by folded over fabric or tape at front or rear or all around.

Figure 1A:
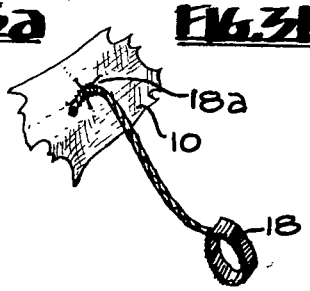
FIG. 1*a* is an enlarged detail view illustrating the manner of attachment of the end retaining loops.

Loops 17 and 18 are attached to the scarf at points 17*a* and 18*a* respectively at a point intermediate the elasticized area and the ends, preferably by means of cords a few inches in length. The manner of attachment is illustrated in detail in FIG. 1*a*.

Figure 4:
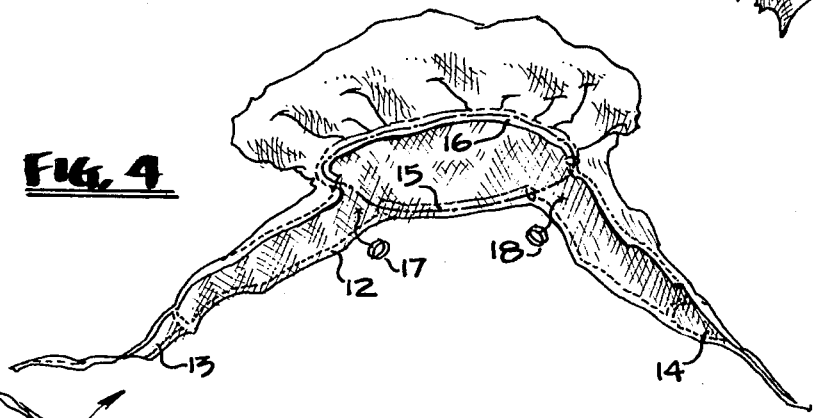
FIG. 4 is a view showing the scarf in position prior to application over the head of a wearer.

FIG. 4 shows the assembled scarf ready for application to the head with the crown portion formed by the gathered elastic as shown at 15, 16, and elongated ends 13 and 14 with attached loops 17 and 18.

Figure 5:
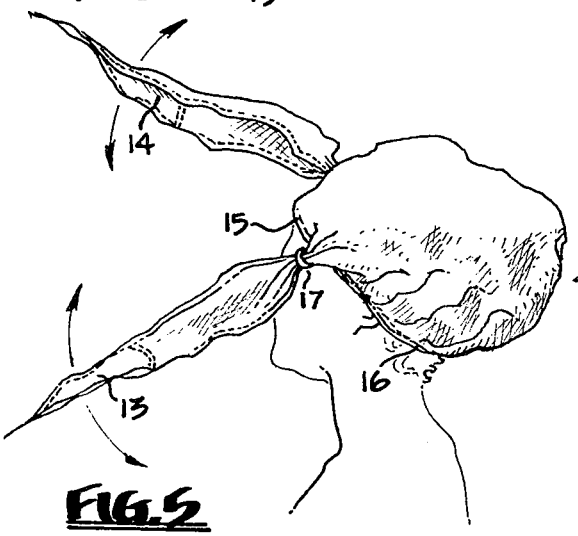
FIG. 5 is a side view in perspective showing the scarf on the head of a wearer with the ends passing through the side loops prior to being tied around the head at the rear or over the head.
Figure 6:
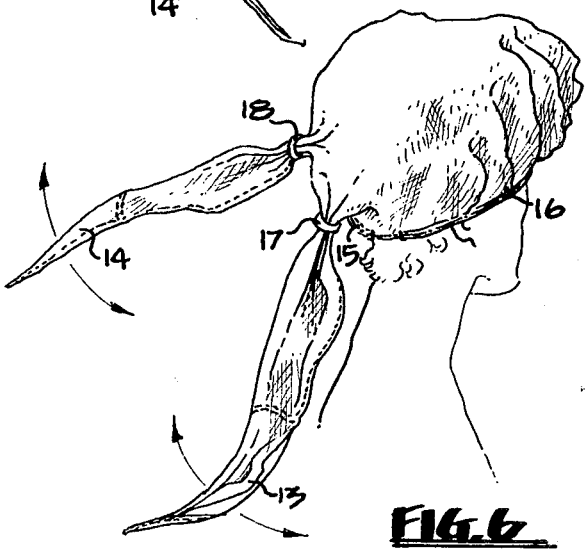
FIG. 6 is a side view in perspective showing the scarf on the head of a wearer with the ends passing through the side loops prior to being tied under the chin or over the head.
Figure 1A:
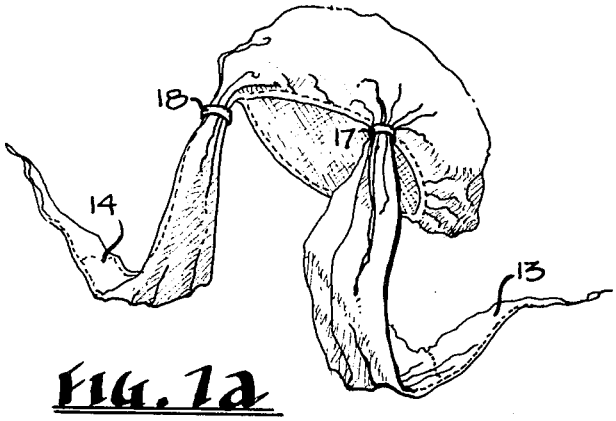
Figure 1B:
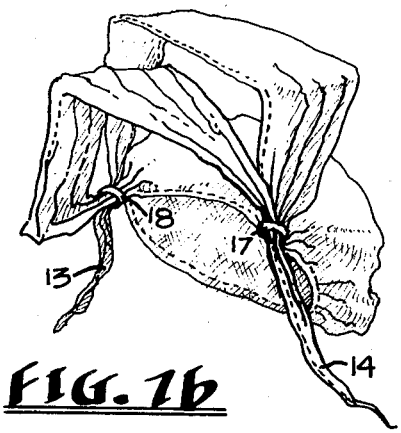
Figure 1:
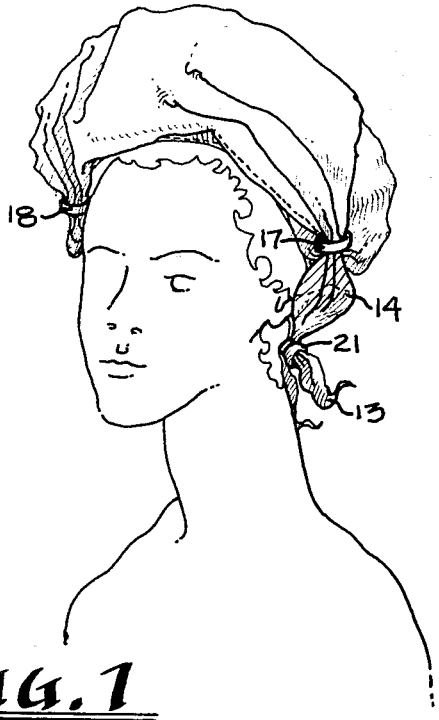
Figure 1C:
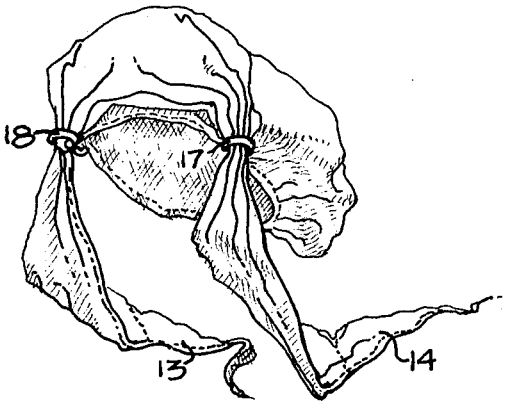
Figure 1D:
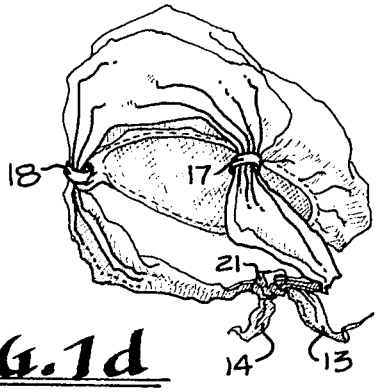

Preparatory to placing upon the head, or after, the elongated ends are drawn through the loops as shown in FIGS. 5 and 6. In FIG. 5 the crown is positioned on the head with elongated ends 13 and 14 drawn through loops 17 and 18 with the base 15 of the elastic area at the front and apex 16 at the rear, thus permitting the ends to be tied at the back of the neck or over top of the head. In FIG. 6 the scarf is shown reversed with the ends drawn through the loops toward the back of the head permitting the ends to be tied under the chin or over the top of the head.

Figure 2A:
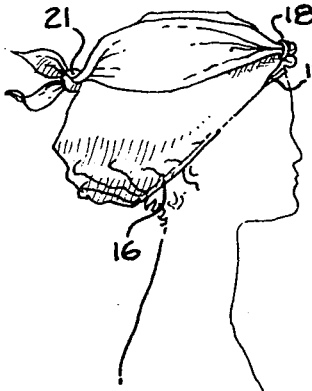
FIGS. 2*a* and 2*b* and 3*a* and 3*b* illustrate side perspective views illustrating various ways in which the scarf is applied to the head.
Figure 2B:
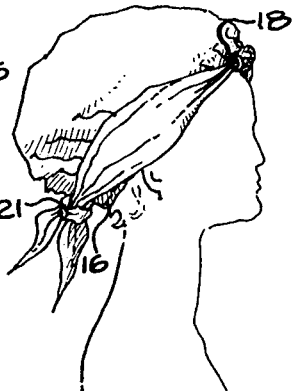
Figure 3A:
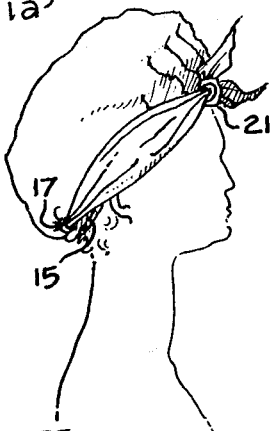
Figure 3B:
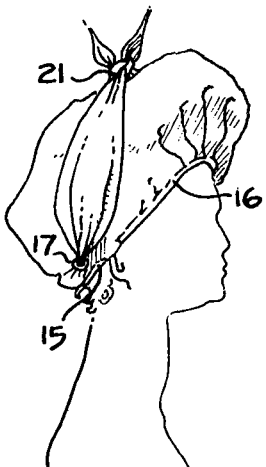

FIGS. 2*a* and 2*b* show alternate modes of tying the ends with the loops pulled forward and the ends drawn through over the forehead and tied behind the head in a knot 21. As shown loop 18 is positioned at one side of the forehead while loop 17 on the other side is not visible.

In FIGS. *3a* and *3b*, the loops are pulled toward the back of the head and the ends drawn through and tied in a knot 21 either over the forehead or on top of the head as shown. (May also be tied under the chin).

In FIG. 7 the scarf is shown assembled on the head with the ends drawn through the loops and reversed and drawn through the opposite loops again to form a turban with the ends overlapping the top of the head and then tied at the rear. FIGS. *7a, 7b, 7c* and *7d* illustrate how this result is obtained. In FIG. *7a* the ends 13 and 14 are drawn through loops 17 and 18. In FIG. *7b* end 13 which has been drawn through loop 17 is pulled over the head and drawn through loop 18. End 14 which has been drawn through loop 18, is pulled over the head and drawn through loop 17. This results in overlapping of the ends over the head as shown in FIG. *7c*. The ends 13 and 14 may then be tied either in back of the head or under the chin to form knot 21 as shown in FIG. *7d*.

The triangular piece of material may be constructed of various fabric materials such as mesh or net material of natural or artificial fibers including but not limited to velvet, nylon, wool, cotton, silk and the like. The edges of the triangular piece of material can be finished with a hem or any type of ribbon, lace, bias tape and the like. The tie ends can be worn and tied under the chin for boating, bicycling or other activities of this nature or the tie ends can be tied in the back and left to drape down the back for a casual effect or the ends of the ties can be secured with a pin or clasp. The crown portion can be made from different materials or contrasting materials as compared with the tie ends. For example, the crown portion may be of silk while the tie ends may be of net or mesh material or the crown portion may be constructed of artificial fur while the tie ends are constructed of soft wool for use in colder climates. The scarf can be worn for formal or informal wear and will fit any head size with the tie ends being oriented in different positions such as being tied in the front or in the rear or crossed in the back and tied in the front or crossed in the front and tied in the rear for various styles. The fullness provided by the crown portion may be oriented in front or back according to the hair style of the wearer. For example, if the fullness or bulk of the hair is worn on top, then the fullness of the crown portion can be worn in front to accommodate the bulk of the hair. Likewise, if the bulk of the hair is worn in back of the head, the fullness can be worn in the back. The elastic band holds the crown portion of the scarf up off of the wearer's hair thus preventing the hair from being matted down and protecting the hair style or hair setting of the wearer. Also, the elastic band holds the cap portion in place so that the wearer can more effectively wrap and tie the tie ends of the scarf in the desired manner thus enabling the wearer to select and obtain different appearance characteristics by varying the style of the scarf. Also, the fullness in the crown portion will allow for the scarf to be worn in covering relation to hair curlers. The particular construction of the crown portion and the tie and pieces enables the tie end pieces to fall down naturally to facilitate the tie ends being arranged in a desired position in relation to the head. The tie ends assume a drape effect automatically to facilitate various styles and configurations. For example, when the tie ends are wrapped around the hear, a classic turban appearance effect is obtained.

The size dimensions of the components may vary. For example, the triangular piece may have a base length of approximately 72 inches or more although this, of course, may vary. Also, the height of the triangular piece may be approximately 16 to 20 inches although this dimension also may vary. The strip of tape or ribbon which receives the elastic band may be approximately 12 to 13 inches in length and the strip of tape or ribbon may be approximately 5 inches from the apex. The elastic band may be anchored to the triangular strip of material at various points in order to prevent shifting of the piece of material in relation to the elastic band. The attachment points may be formed by stitching and it may be necessary to only stitch at diagonally opposed points. As indicated, the elastic band is used to form a circular entrance area to the crown portion and the elastic band is dimensioned so that when in the normal contracted state, the crown portion will adequately fit the head of the wearer.

The loops 17 and 18 may be formed of fabric or may be in the form of plastic or metal rings of circular or other desired shape. The diameter of the loops may range from 1 inch to 3 or more inches as desired.

The resulting scarf structure thus provides a simple and attractive head covering which can be utilized in numerous way to be both utilitarian and ornamental. As described therein the modifications are illustrative of the invention and numerous variations and changes will readily occur to those skilled in the art as within the scope of the invention.

I claim:

1. A head covering comprising a generally triangular shaped piece of flexible fabric material having a base length substantially greater than the height thus providing an enlarged central area and elongated ends, a crown portion defined by a strip of elasticized material coupled to the fabric material and which in the relaxed state forms a head enclosing area within the central area of the triangular piece, and a pair of loops each of which is attached to the fabric at a point between the crown portion and the elongated end adapted to receive said ends therethrough.

2. A head covering according to claim 1 wherein the loop is attached to the fabric by means of a cord of desired length.

3. A head covering according to claim 2 wherein each end is drawn through the loop adjacent thereto.

4. A head covering according to claim 3 wherein the ends are tied together in a knot.

5. A head covering according to claim 3 wherein the ends are drawn through adjacent loops and then in reversed position drawn through the loops on the opposite side to define on a structure with overlapping end portions, with the ends extending therethrough.

6. A head covering according to claim 5 wherein the ends are tied together in a knot.

7. A head covering comprising a generally triangular piece of fabric having an elongated base substantially greater than its height providing a central enlarged area and elongated ends, a crown portion defined by an elastic band coupled to the fabric and which in the relaxed position conforms to the head of a wearer, and a pair of loops each of which is attached to the fabric at a point between the crown portion and the elongated end, said head covering being positioned on the head of a wearer with the elongated ends drawn through the loops adjacent thereto and tied in a knot at a desired point around the head of the wearer.

8. A head covering according to claim 7 wherein the elongated ends which pass through the loops are reversed and extend over the head and through the loop attached to the opposite end to form an overlapping assembly.

9. A head covering according to claim 8 wherein the ends are tied together for form a knot.

* * * * *